US006799838B2

(12) United States Patent
Kubota et al.

(10) Patent No.: US 6,799,838 B2
(45) Date of Patent: Oct. 5, 2004

(54) LIQUID DISCHARGE HEAD LIQUID DISCHARGE METHOD AND LIQUID DISCHARGE APPARATUS

(75) Inventors: Masahiko Kubota, Tokyo (JP); Masaru Iketani, Atsugi (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/384,971

(22) Filed: Aug. 30, 1999

(65) Prior Publication Data

US 2003/0038852 A1 Feb. 27, 2003

(30) Foreign Application Priority Data

Aug. 31, 1998 (JP) ..... 10-245471
Aug. 31, 1998 (JP) ..... 10-245988

(51) Int. Cl.[7] ..... B41J 2/05
(52) U.S. Cl. ..... 347/64
(58) Field of Search ..... 347/62, 64, 15

(56) References Cited

U.S. PATENT DOCUMENTS

| | | | | | |
|---|---|---|---|---|---|
| 4,339,762 | A | * | 7/1982 | Shirato et al. | 347/62 |
| 4,392,907 | A | * | 7/1983 | Shirato et al. | 156/252 |
| 4,429,321 | A | | 1/1984 | Matsumoto | 346/140 R |
| 4,458,256 | A | * | 7/1984 | Shirato et al. | 347/58 |
| 4,723,129 | A | | 2/1988 | Endo et al. | 346/1.1 |
| 4,831,391 | A | | 5/1989 | Asai | 346/140 R |
| 5,071,618 | A | * | 12/1991 | Sanchez-Caldera et al. | 419/12 |
| 5,293,182 | A | | 3/1994 | Sekiya et al. | 346/140 R |
| 5,367,285 | A | * | 11/1994 | Swinehart et al. | 338/308 |
| 5,481,287 | A | * | 1/1996 | Tachihara | 347/62 |
| 5,600,356 | A | | 2/1997 | Sekiya et al. | 347/62 |
| 5,658,471 | A | * | 8/1997 | Murthy et al. | 216/27 |
| 5,660,739 | A | * | 8/1997 | Ozaki et al. | 216/27 |
| 6,224,191 | B1 | * | 5/2001 | Saito et al. | 347/48 |

FOREIGN PATENT DOCUMENTS

| | | | | |
|---|---|---|---|---|
| EP | 0 294 631 | | 12/1988 | B41J/3/04 |
| EP | 0 750 991 | A2 | 1/1997 | B41J/2/14 |
| EP | 764531 | * | 3/1997 | |
| EP | 0 819 538 | A2 | 1/1998 | B41J/2/14 |
| EP | 0 838 846 | A2 | 4/1998 | H01L/21/311 |
| JP | 55-81172 | | 6/1980 | |
| JP | 55-132259 | | 10/1980 | |
| JP | 59-26270 | | 2/1984 | |
| JP | 7-276639 | A | 10/1995 | B41J/2/05 |

* cited by examiner

*Primary Examiner*—Michael S. Brooke
(74) *Attorney, Agent, or Firm*—Fitzpatrick, Cella Harper & Scinto

(57) ABSTRACT

The invention provides a liquid discharge head, a substrate for the head, a liquid discharge method, and a liquid discharge apparatus, in which a high gradation can be easily obtained and simplification of a circuit formation and miniaturization of a recording head can be achieved. According to the present invention, a liquid discharge head comprises a heat generating element for generating thermal energy which is used for discharging liquid from a discharge port, and a protective layer for protecting the heat generating element, provided on the heat generating element. In the discharge head, the protective layer has a first region with a substantially uniform and desired thickness and a second region with a substantially uniform thickness thinner than said desired thickness, the volume of liquid droplets discharged from the discharge port is changed by changing electric energy applied to the heat generating element.

13 Claims, 9 Drawing Sheets

LIQUID DISCHARGE HEAD LIQUID DISCHARGE METHOD AND LIQUID DISCHARGE APPARATUS

BACKGROUND OF THE INVENTION

1. Field of the Invention

The present invention relates to a liquid discharge head, a liquid discharge method and a liquid discharge apparatus, in which a change of state including generation of a bubble in a liquid is generated using thermal energy and the liquid is discharged from a discharge port in accordance with the change of state thereby to record. The present invention can be applied to devices such as a general printer, a copy machine, a facsimile including a communication system, and a word processor including a printer section, and further to an industrial recording device compositely combined with various kinds of processing units.

2. Related Background Art

A liquid discharge apparatus, particularly, an ink jet recording apparatus is ideal as a non-impact recording apparatus in modern business offices and other clerical work sections where quiet is required. Recently, from demands for higher density and higher speed recording properties and easier maintenance properties, further development and improvement of the ink jet recording head have been carried out. Particularly, in an ink jet recording apparatus using techniques disclosed in U.S. Pat. No. 4,723,129, a high density and high speed recording can be sufficiently performed by the structural feature. Therefore, the device is greatly supported in the market. Further, as one of techniques which can attain the high density and high speed for the recording head, U.S. Pat. No. 4,429,321 provides an ink jet recording head having a highly integrated structure.

On the other hand, to attain the recording of a high image quality using a recording head, which discharges only a desired discharge amount of droplets from a discharge port, the recording considerably depends on the providing density of heating elements of a recording head. That is, it uses a method of jetting ink to the same pixel position a plurality of times. This however invites problems such that the scanning times of the recording head are inevitably increased and a general printing speed is liable to decrease.

Japanese Patent Publication No. 62-48585 provides a multi-level output color ink jet recording head in which a plurality of heating elements are provided in one nozzle so that different discharge amounts of droplets can be discharged from a discharge port. This is, referred to as, so called, "multi-level heater". For example, in the multi-level heater n heater elements are provided in one nozzle and are separately connected to a driver so that voltage can be independently applied to each of the heating elements. Further, the sizes of the heating elements are changed so that the heat release values are differentiated from each other in the respective heating elements in one nozzle. In this case, the recording dots by n heating elements are different from each other and {n Cn−1+n Cn−2+. . . +n C2+n C1+1} kinds of recording dots can be formed by the combination of simultaneously driven heating elements. That is, {n Cn−1+n Cn−2+ . . . +n C2+n C1+1} level gradation can be obtained with one nozzle.

However, since in the above-mentioned structure, a driving element such as a driving transistor or the like should be provided so as to correspond to the heating element by 1:1, a density n times greater than the nozzle density is required for the driving element to obtain {n Cn−1+n Cn−2+. . . +n C2+n C1+1} level gradation. Although a bipolar transistor and a N-MOS transistor have been used as a driving element for the heating element, one example of the area length of the driving element taken along a direction along the nozzle is about 70 μm. In a case of, for example, 360 dpi recording head, a providing length of one driving element is 70/n μm. If a recording head is a 720 dpi recording head, the length of 35/n μm is required. As the result, to increase the density of the driving element, it is required to arrange a transistor at n steps or the like. In this case, control circuit wiring becomes complicated or the size of a recording head substrate must be enlarged. As the result, the structure is liable to lead to the increase of cost, and further, it becomes difficult to adapt the need of miniaturization of the recording head.

Incidently, with the use of a liquid discharge technology using thermal energy in many fields, in addition to the need for a higher image quality, a technology of satisfactorily discharging various liquids such as a high viscosity liquid or the like and a liquid discharging technology having a higher liquid discharge efficiency as compared to conventional technologies, are recently, increasingly desired. From such viewpoints various liquid discharge technologies are disclosed in, for example, Japanese Patent Publication No. 61-59916, Japanese Patent Application Laid-Open No. 55-81172, Japanese Patent Application Laid-Open No. 59-26270, and the like.

SUMMARY OF THE INVENTION

An object of the present invention is to provide a liquid discharge head, a liquid discharge method and a liquid discharge apparatus, in which a high gradation can be easily obtained and the simplification of a circuit arrangement and the miniaturization of a recording head can be attained without using a structure in which a plurality of heating elements are provided in one nozzle.

Another object of the present invention is to provide a liquid discharge head, a liquid discharge method and a liquid discharge apparatus, in which the volume of a droplet discharged is changed and a concentration change and a dot change on a recording medium can be realized by controlling the volume of a bubble generated in al liquid flow path.

Still another object of the present invention is to provide a liquid discharge head comprising a heat generating element for generating thermal energy which is used for discharging liquid from a discharge port, and a protective layer provided on the heat generating element to protect the heat generating element, wherein the protective layer has a first region with a substantially uniform and desired thickness and a second region with a substantially uniform thickness thinner than the desired thickness, the volume of liquid droplets discharged from the discharge port is changed by changing electric energy applied to the heat generating element.

Still another object of the present invention is to provide a liquid discharge head comprising a heat generating element for generating thermal energy which is used for discharging liquid from a discharge port, a protective layer provided on the heat generating element to protect the heat generating element and a moving member provided facing the heat generating element and having a free end which is displaced in accordance with generation of a bubble due to the thermal energy, wherein the protective layer has a first region with a substantially uniform and desired thickness and a second region with a substantially uniform thickness thinner than the desired thickness, the volume of liquid droplets discharged from the discharge port is changed by changing electric energy applied to the heat generating element.

Still another object of the present invention is to provide a liquid discharge method using a liquid discharge head having a heat generating element for generating thermal energy which is used for discharging liquid from a discharge port, and a protective layer for protecting the heat generating element, provided on the heat generating element, the protective layer having a first region with a substantially uniform and desired thickness and a second region with a substantially uniform thickness thinner than the desired thickness, wherein a size of a bubble generated on the heat generating element is changed by changing electric energy applied to the heat generating element while keeping a region of the starting point of bubbling to the second region, whereby the volume of liquid droplets discharged from the discharge port is changed.

Still another object of the present invention is to provide a liquid discharge method using a liquid discharge head having a heat generating element for generating thermal energy which is used for discharging liquid from a discharge port, a protective layer for protecting the heat generating element, provided on the heat generating element and a moving member provided facing the heat generating element and having a free end which is displaced in accordance with generation of a bubble due to the thermal energy, the protective layer having a first region with a substantially uniform and desired thickness and a second region with a substantially uniform thickness thinner than the desired thickness, wherein a size of a bubble generated on the heat generating element is changed by changing electric energy applied to the heat generating element while keeping a region of the starting point of bubbling to the second region, whereby the volume of liquid droplets discharged from the discharge port is changed.

According to the present invention the volume of a droplet discharged from one discharge port can be easily varied in a plurality of steps. Further a high gradation can be attained by selectively changing a signal inputted to one heat generating element without providing a plurality of heat generating elements in one nozzle. Further, since it is not necessary to arrange a heat generating element at a high density with necessary level, simplification of a circuit arrangement and miniaturization of a recording head can be attained. Additionally, since the present invention has a partially thin protective layer area, it has the effects that the consumption power necessary for obtaining an ordinary amount of liquid discharge can be further lowered than conventional cases.

The present invention provides the protective layer on the heat generation layer has stepwise a first region having a substantially uniform predetermined thickness and a second region having a uniform thickness smaller than the predetermined thickness. According to this arrangement, reaching temperatures at the regions for a predetermined applied energy are different for each other so that digital-like simple gradation recording can be obtained with high feasibility.

DETAILED DESCRIPTION OF THE PREFERRED EMBODIMENTS

Figure 1:
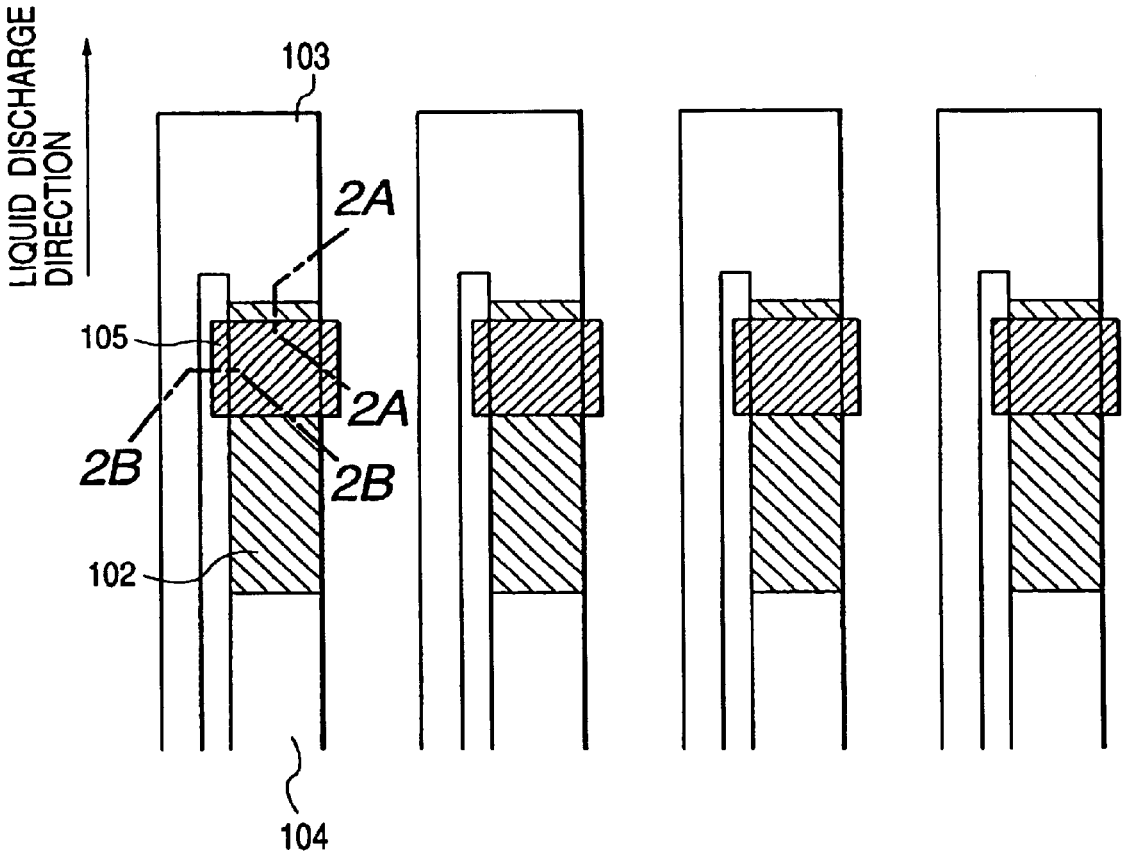
FIG. 1 is a schematic plan view showing a substrate for a liquid discharge head according to one embodiment of the present invention.

In this specification a term "printing" (or "recording") is used not only in a case where significant information such as characters, figures etc., is formed, but also in a case where an image, a pattern etc., are formed on a medium to be printed in a wide meaning or processing of a medium is carried out, regardless of significance or insignificance, or regardless of visualization so that a human can visually perceive. A term "a printing medium (a medium to be printed)" means not only a paper used in a general printing apparatus, but also an ink-receivable material such as a cloth, a plastic film, a metallic plate, glass, ceramics, wood, leather and the like. Further, a term "ink (sometimes "liquid")" should be widely interpreted as the definition of the above-mentioned "printing" and means a liquid which can be applied to the formation of an image, a pattern etc., by being imparted onto a printing medium, processing of a printing medium, or treatment of ink (for example, solidification or insolubilization of colorant in ink imparted to the printing medium).

Embodiments of the present invention will be described in detail below with reference to drawings. The same reference numerals are designated to the same portions.

Figure 2A:
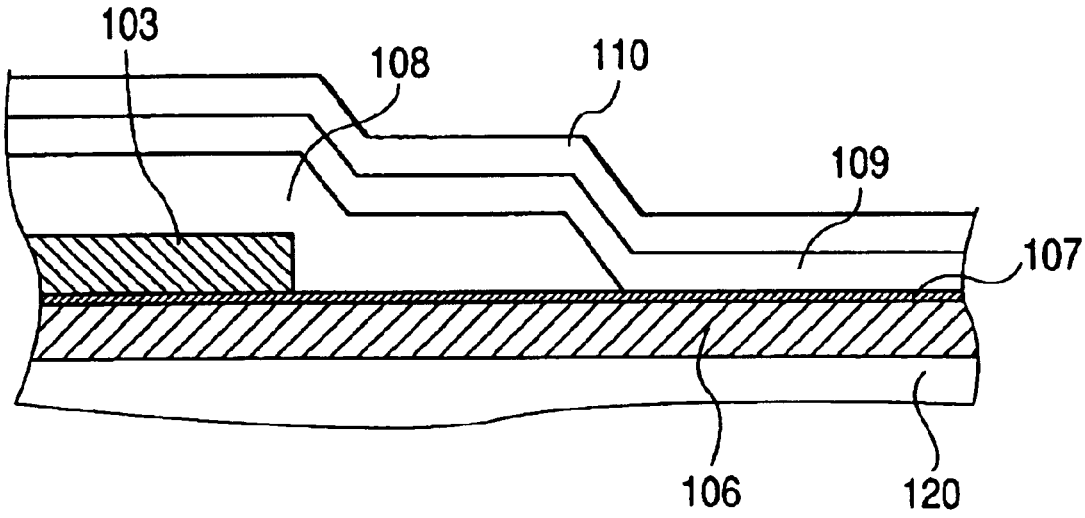
FIG. 2A is a schematic cross-sectional view showing the substrate for the head vertically taken along the one dotted chain line 2A—2A in FIG. 1
Figure 2B:
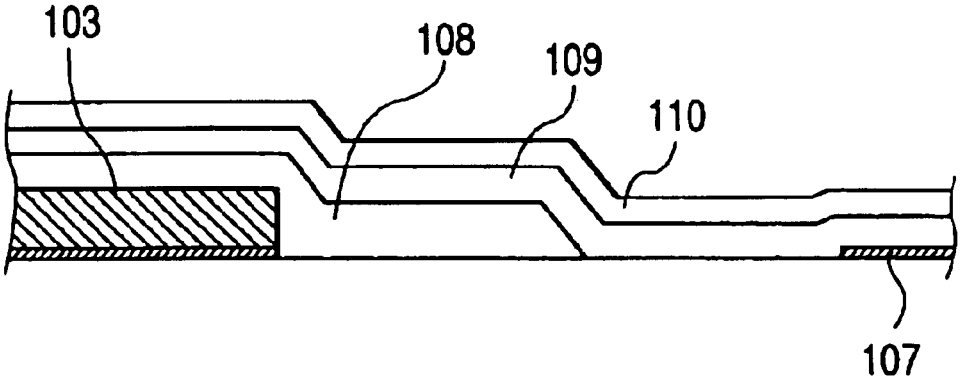
FIG. 2B is a schematic cross-sectional view showing the substrate for the head vertically taken along the one dotted chain line 2B—2B in FIG. 1, respectively.

FIG. 1 is a schematic plan view showing an area near the heat generating element on a substrate for a liquid discharge head according to one embodiment of the present invention, FIGS. 2A and 2B are schematic cross-sectional views showing the substrate vertically taken to the surface of the substrate along the one-dotted chain line 2A—2A and 2B—2B in FIG. 1, respectively.

In this embodiment, as a substrate 120 for forming a heating element, an Si substrate having no element or a driving IC-mounted Si substrate is used. In a case of the former Si substrate, a heat storage layer comprises $SiO_2$ is formed below a heating resistor by a thermal oxidation process, a sputtering process or a CVD process or the like. In a case of the latter IC-mounted Si substrate, an $SiO_2$ heat storage layer is also formed during the production process. In FIG. 2A, the reference numeral 106 denotes a heat storage layer. Then a heating resistor layer 107 composed of TaN, $HfB_2$, TaAl and the like is formed to a thickness of about 50 to 1000 Å by a reactive sputtering process or the like, and a wiring electrode layer 103 of Al etc., is formed to a thickness of about 0.2 to 1.0 μm by a sputtering process. Then to form a wiring pattern shown in FIG. 1 by a photolithography process, the wiring electrode layer and the heating resistor layer are continuously etched by a reactive ion etching process.

To expose a heat generating portion 102 also using a photolithography process as shown in FIG. 1, a portion of the wiring electrode layer 103 is removed by a wet etching process. Incidentally, the end portion of the wiring electrode layer 103, not shown in FIG. 1 is used as a wire bonding pad in a case of an Si substrate having no element, on the other hand, the end portion thereof is connected to an electrode in the lower portion not shown through a through-hole in an IC mounted Si substrate.

Then a first protective layer 108 is formed by a plasma CVD process or the like. Then as shown in FIG. 1, to form a region (second region) 105 where a thin protective layer is formed on the downstream side with respect to the liquid discharge direction in the heating portion 102, an opened pattern is formed in a mask by using, for example, a photolithography process, and a first protective layer 108 is wet-etched using the heating resistor layer 107 as an etching stop layer (stopper). After that a second protective layer 109 is formed using a plasma CVD process or the like. In this embodiment, a region on the heat generating portion other than the second region substantially corresponds to the first region.

In the present invention, as explained above, in a case where after the first protective layer 108 is formed and a portion of the first protective layer 108 is etched using the heating resistor layer 107 as an etching stop layer, the second protective layer 109 is formed, materials of the first protective layer 108 and the second layer 109 may be the same or not. Further, in the present invention, two kinds of protective layers having different properties, particularly, etching properties are laminated and any one of the protective layers, particularly, the upper protective layer is removed by a selective etching process between both protective layers, so that a thin protective layer-formed region 105 may be formed. In the combination of protective layers in such case, for example, a SiN film is formed as the first protective layer 108 (lower layer), a PSG (phosphosilicate glass) film is formed as the second protective layer 109 (upper layer), and a portion of the upper layer, i.e., PSG film is removed by a desired area by a selective etching process using buffered hydrofluoric acid, so that a thin protective layer-formed region 105 can be formed. Alternatively, after the lower layer of $SiO_2$ film and the upper layer of SiN film are formed, a thin protective layer-formed region 105 can be also formed by selectively etching the upper layer by using hot phosphoric acid. Each thickness of the first and second protective layers may be suitably formed in consideration of the thermal conductivity of a material to be used, the area of the thin protective layer-formed region 105, the discharge amount to be controlled. However, in the region 105 where at least a protective layer was thinly formed, the protecting layer must be formed in a film thickness such that its functions can be attained. Further, to ensure a sufficient gradation, the film thickness difference between the thin protective layer-formed region 105 and an ordinary region is desirably about 3000 Å to 9000 Å. In the present invention, the area of the thin protective layer-formed region 105 may be appropriately set in consideration of the respective materials and film thickness so that a desired discharge amount can be obtained.

Then, a metallic film of Ta or the like which forms a passive state is formed to a thickness of about 1000 Å to 5000 Å by a sputtering process as shown by the reference numeral 110 in FIGS. 2A and 2B, as an anti-cavitation layer. Finally, openings for pads are formed at desired positions of wiring layers 103 and 104 by a photolithography process, thereby to form a substrate 101 of an ink jet recording head.

Figure 3:
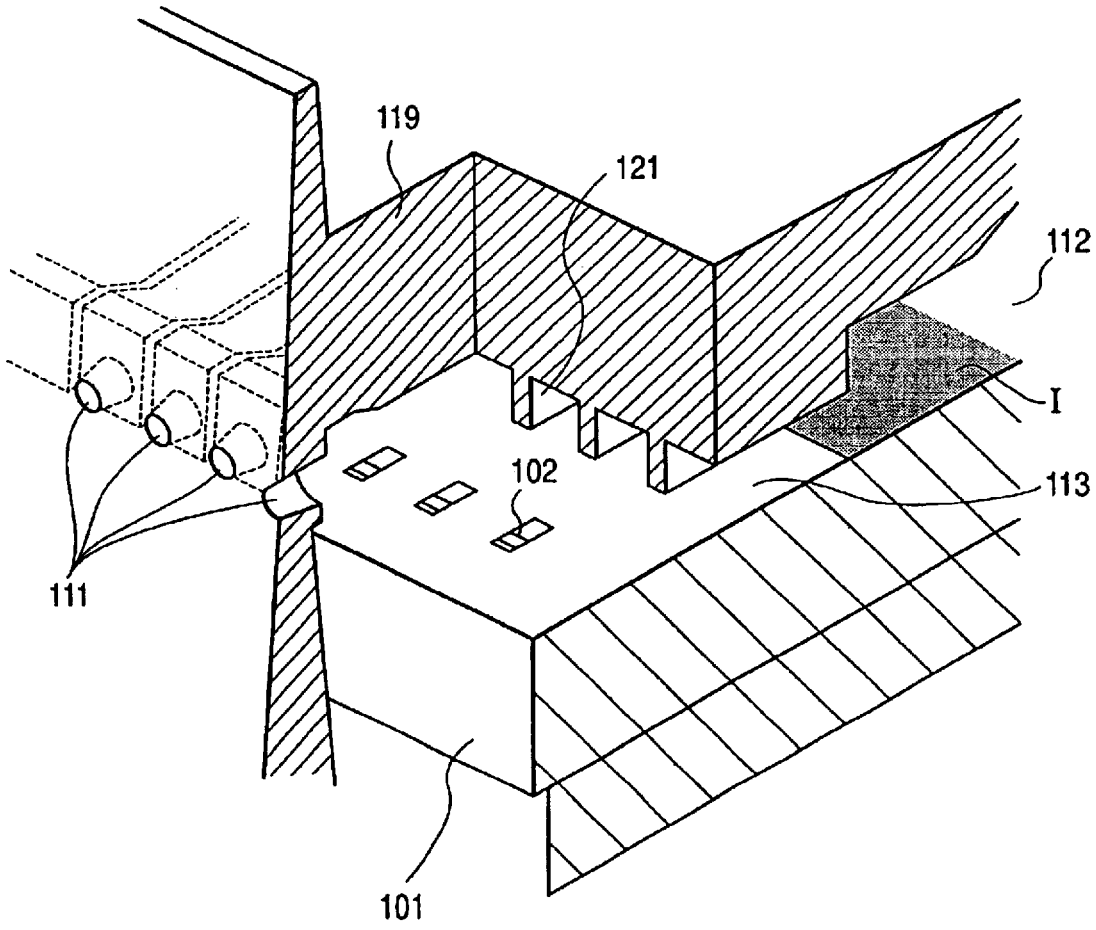
FIG. 3 is a schematic partially-cut perspective view showing a main portion of a liquid discharge head according to one embodiment of the present invention.

After the completion of the recording head substrate, as shown in FIG. 3, discharge ports 111 or the like for discharging ink are formed, thereby to complete an ink jet recording head. A liquid flow path 113 is communicated with a common liquid chamber 112 for supplying a recording liquid to each discharge port. The liquid flow path 113 is separated into some parts by separating walls 121 provided on a top plate 119. The recording liquid is introduced into this common liquid chamber 112 from an external portion of the recording head through a liquid supply opening not shown in accordance with necessity. On the connection of the top plate 119 the heat generating portion 102 is preferably, sufficiently positioned so that it may correspond to each of the liquid flow paths 113. Thus the top plate 119 is connected to the substrate 101 thereby to form the liquid flow paths 113. Further, to the electrode 103 is attached a lead substrate (not shown) having an electrode lead for applying a desired pulse signal from an external portion of the recording head. Thus, an ink jet recording head is completed as shown in FIG. 3.

Incidentally, the formation of the liquid discharge port or liquid flow path etc., is not necessarily carried out by providing a top plate with grooves illustrated in FIG. 3, but may be carried out by forming side walls of the liquid flow path by a patterning process of a photosensitive resin. The present invention is not limited to only the multi-array-type ink jet recording head having the above-mentioned plurality of discharge ports, but it can be applied to the single-array-type ink jet recording head having single liquid discharge port.

Figure 5:
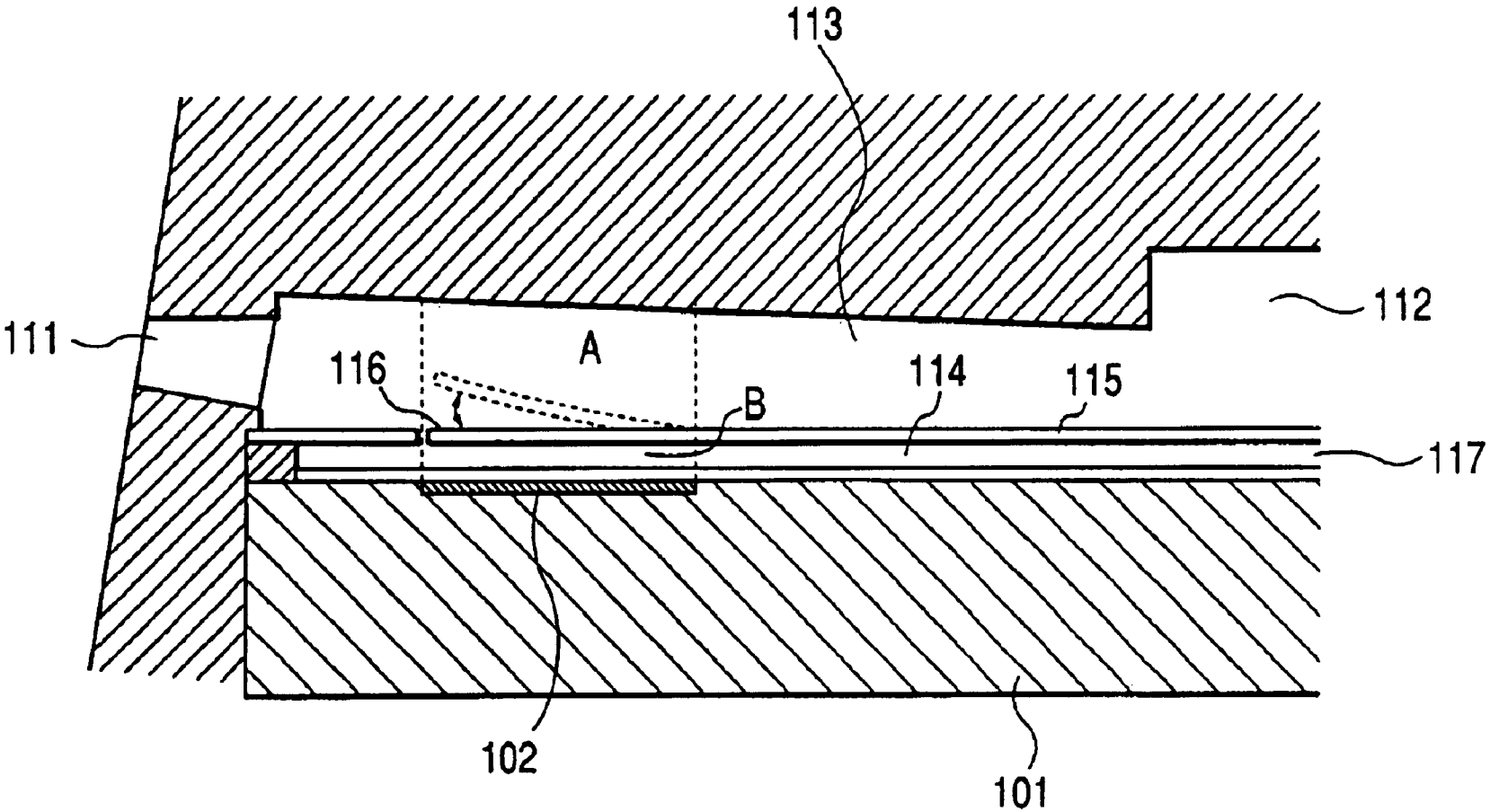
FIG. 5 is a schematic cross-sectional view showing a liquid discharge head according to one embodiment of the present invention.

Then a liquid discharge head according to another embodiment of the present invention will be described with reference to FIG. 5. As shown in FIG. 5, after a photosensitive resin (dry film) is applied onto a substrate 101 with a spinner, the resin film is exposed and developed by using a photolithography process so that a second liquid flow path 114 for supplying a bubbling liquid in every heat generating portion 102. The separating wall 115 constituting a movable member is made of metal such as nickel or the like.

Figure 6:
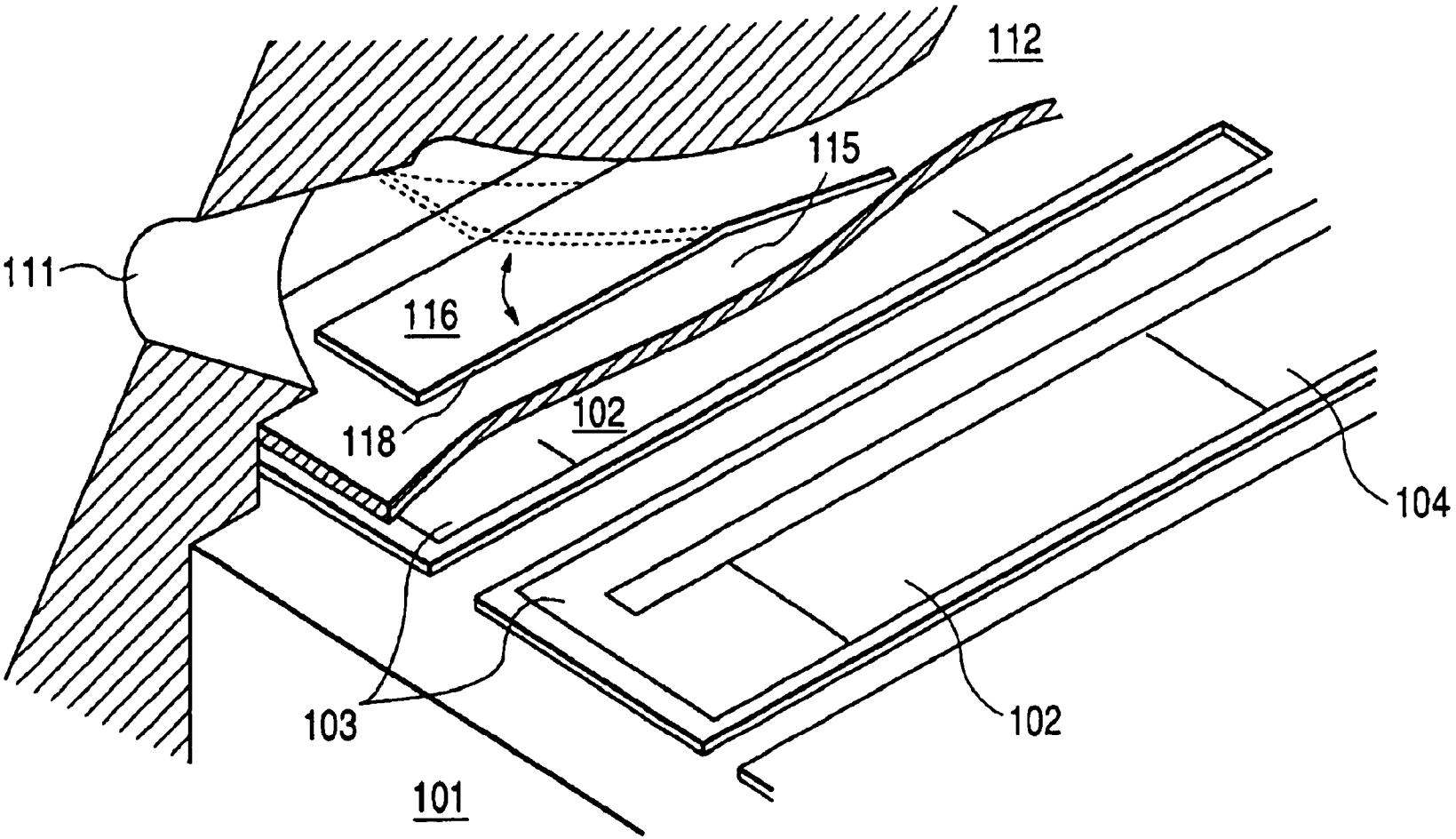
FIG. 6 is a schematic partially-cut perspective view showing a main portion of a liquid discharge head of FIG. 5.

FIG. 5 is a schematic cross-sectional view taken along the direction of the liquid flow path, showing a liquid discharge head according to another embodiment of the present invention. FIG. 6 is a schematic partially-cut perspective view showing the main portion of the liquid discharge head. As shown in FIGS. 5 and 6, a second liquid flow path 114 for a bubbling liquid is formed on a substrate 101 on which a heat generating portion 102 was provided. On the liquid flow path 114 is provided a first liquid flow path 113 for a discharge liquid directly communicated with a discharge port 111. Between the first and second flow paths 113 and 114 is provided a separating wall 115 made of a material having elasticity such as metal or the like, which wall 115 separates the discharge liquid in the first liquid flow path 113 from the bubbling liquid in the second liquid flow path 114. Incidentally, as described later, when the bubbling liquid and the discharge liquid are the same liquid, the respective common liquid chambers may be commonly used as one chamber.

The height of the second liquid flow path 114 is preferably given so that it is smaller than the maximum height of a bubble which is generated by the heat generating portion 102. Particularly, it is preferred that the second liquid flow path 114 is formed in a height smaller than the minimum height of a bubble which is generated in the thin prospective layer-formed region 105 and the bubble generated in the region 105 is extended to the first liquid flow path 113. Thus, the height of the second liquid flow path 114 may be appropriately set in the most suitable range so that a desired discharge pressure is given.

Although in the above explanation nickel is used as the separating wall 115 defining a movable member, the separating wall is not limited thereto. As a material which defines the separating wall or the movable member, a material may be used, which has a sufficient liquid resisting properties to a bubbling liquid and a discharge liquid, and has elasticity for satisfactorily transmitting the bubbling energy to the discharge liquid and which can form fine slits. Materials of the movable member having a high durability include, metal, such as, in addition to nickel, silver, gold, iron, titanium, aluminum, platinum, tantalum and the like, alloy of the metal or other metal including stainless steel, phosphor bronze and the like, or resin having a nitrile group such as polyacrylonitrile, butadiene resin, styrene resin, resin having an amide group such as polyamide and the like, resin having a carboxyl group such as polycarbonate and the like, resin having an aldehyde group such as polyacetal, resin having sulfone group such as polysulfone and the like, other resin such as liquid crystal polymer and the like, and their compound and the like. Further, high ink-resisting materials preferably include metal such as gold, tungsten, tantalum, nickel, titanium and the like, alloy such as stainless steel, these metal or alloy-coated articles, or resin having an amide group such as polyamide, resin having an aldehyde group such as polyacetal and the like, resin having a ketone group such as polyetherether ketone and the like, resin having an imide group such as polyimide and the like, resin having a hydroxide group such as phenol resin and the like, polyalkylene resin such as polyethylene, polypropylene and this like, resin having an epoxy group such as epoxy resin and the like, resin having an amino group such as melamine resin and the like, resin having a methylene group such as xylene resin and the like and their compound, and further ceramics such as silicon dioxide and the like.

As a material of the separating wall the same material as that of the above-mentioned movable member can be used. The separating wall may be integrally formed with the movable member. The thickness of the separating wall can be determined in consideration of the material quality and shape etc., from the viewpoints of the realization of its strength and satisfactory operations of the movable member, and is preferably about 0.5 to 10 $\mu$m.

Incidentally, When, for example, a bubbling liquid is different from a discharge liquid and the prevention of the both liquids from being mixed is required, the width of a gap (slit) between the movable member and the separating wall have such a distance that meniscus is formed between the both liquids and the communication with the liquids is only prevented. For example, when about 2 cP of a liquid is used as a bubbling liquid and 100 cP or more of a liquid is used as a discharge liquid, even about 5 $\mu$m of the width can prevent mixing of the liquids, but 3 $\mu$m or less of the width is desirable.

A part of the separating wall 115 positioned at a projected space of the heat generating portion 102 in the upward direction (which is referred to as "a discharge pressure generation region" that is a region A and a bubble generation region B in FIG. 5) has a free end in the discharge port side (the downstream side of a liquid flow) due to a slit 118, and defines a cantilever beam-shaped movable member 116 having a support in a common chamber (112, 117) side, whereby the movable member 116 is provided facing the bubble generation region B. Thus, the movable member 116 is operated in an arrow direction in FIG. 5 in such a manner that it is opened in the first flow path 113 side by bubbling of a bubbling liquid as described later. In FIG. 6, on a substrate 101 on which wiring electrodes 103 and 104 for applying an electric signal to this heat generating portion were provided, is also provided a separating wall 115 through a space which defines a second liquid flow path 114.

Figure 7:
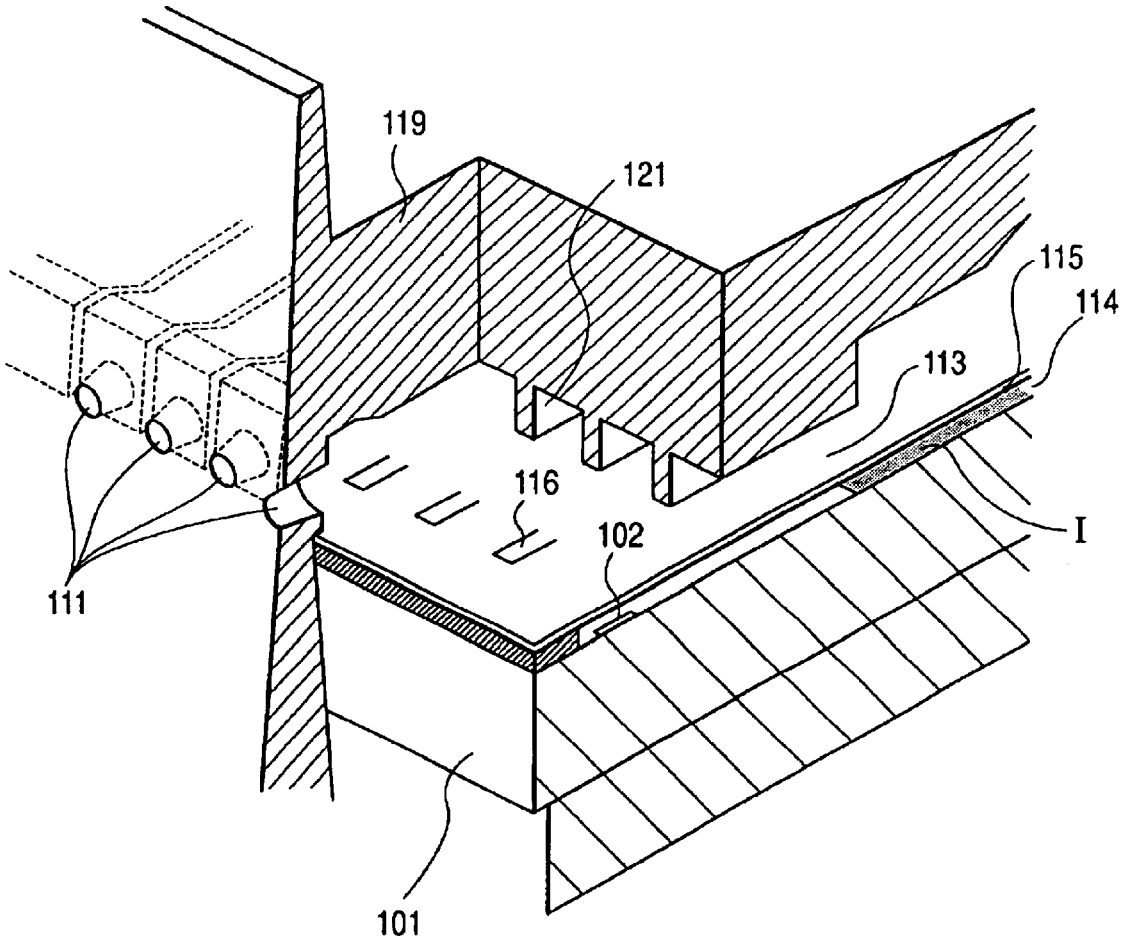
FIG. 7 is a schematic partially-cut perspective view showing the liquid discharge head of FIG. 5.

After the completion of a recording head substrate, as shown in FIG. 7, discharge ports 111 or the like for discharging ink are formed, thereby to complete a liquid discharge head. A liquid flow path 113 is communicated with a common liquid chamber 112 for supplying a recording liquid to each discharge port. The liquid flow path 113 is separated into some parts by separating walls provided on a top plate 119. The discharge liquid is introduced into this common liquid chamber 112 from an external portion of the head through a liquid supply opening not shown in accordance with necessity. On the connection of the top plate 119, it is preferred that the heat generating portion 102 and the movable member 116 are sufficiently positioned respectively, so that they may correspond to each of the liquid flow paths 113. Thus, the top plate 119 is connected to the substrate 101, thereby to form liquid discharge ports 111 communicated with a discharge pressure generation region A. Further, to the electrodes 103 and 104 are attached lead substrates (not shown) each having an electrode lead for applying a desired pulse signal from a external portion of the head. Thus, a liquid discharge head shown in FIG. 7 is completed.

As the bubbling liquid and the discharge liquid the same liquid may be used or different liquids may be used. In a case where the same liquid is used, various liquids can be used if the liquid is not deteriorated with heat applied by a heat generating portion, deposit is difficult to be generated on a heat generating portion by heating, a reversible change of the vaporization and condensation can be performed with heat, and the liquid does not deteriorate the liquid flow path, the movable member or the separating wall or the like.

As a first liquid (a discharge liquid), which is used for recording among such liquids, ink having a composition used in a conventional recording device can be used.

On the other hand, in a case where the bubbling liquid and the discharge liquid are different liquid from each other, as the bubbling liquid, liquid having the above-mentioned properties may be used. For example such liquids include methanol, ethanol, n-propanol, isopropanol, n-hexane, n-heptane, n-octane, toluene, xylene, methylene dichloride, trichloroethylene, "Freon TF", "Freon BF" (Both Freons are trade names of Du Pont Co.), ethyl ether, dioxane, cyclohexane, methyl acetate, ethyl acetate, acetone, methyl ethyl ketone, water and their mixture. On the other hand, as the discharge liquid in this case, various liquids can be used regardless of the presence or absence of bubbling properties and thermal properties. Particularly, even a liquid having low bubbling properties, which was conventionally difficult to discharge, a liquid which is liable to change in properties or deteriorate with heat or a liquid having a high viscosity or the like may be used.

In the above descriptions, although a configuration was explained, in which a thin protective layer-formed region 105 was provided on the downstream side with respect to the liquid discharge direction, the region 105 may be formed on any portion on the heat generating portion 102. However, to surely propagate the power of a bubble to liquid, the region 105 is preferably formed on the front portion in the liquid discharge direction, as mentioned above. Although single region 105 is formed on each of heat generating portions 102, a plurality of regions may be formed thereon.

Alternatively, the present invention includes a configuration in which a flow path group having a structure shown in FIG. 3 and a flow path group having a structure shown in FIG. 7 are closely provided and both flow paths are independently used. Additionally, a reference numeral I denotes a region where a driving circuit having a plurality of functional elements provided for independently driving a plurality of heat generating portions is provided inside of the substrate 101 on which a plurality of heat generating portions.

Figure 9:
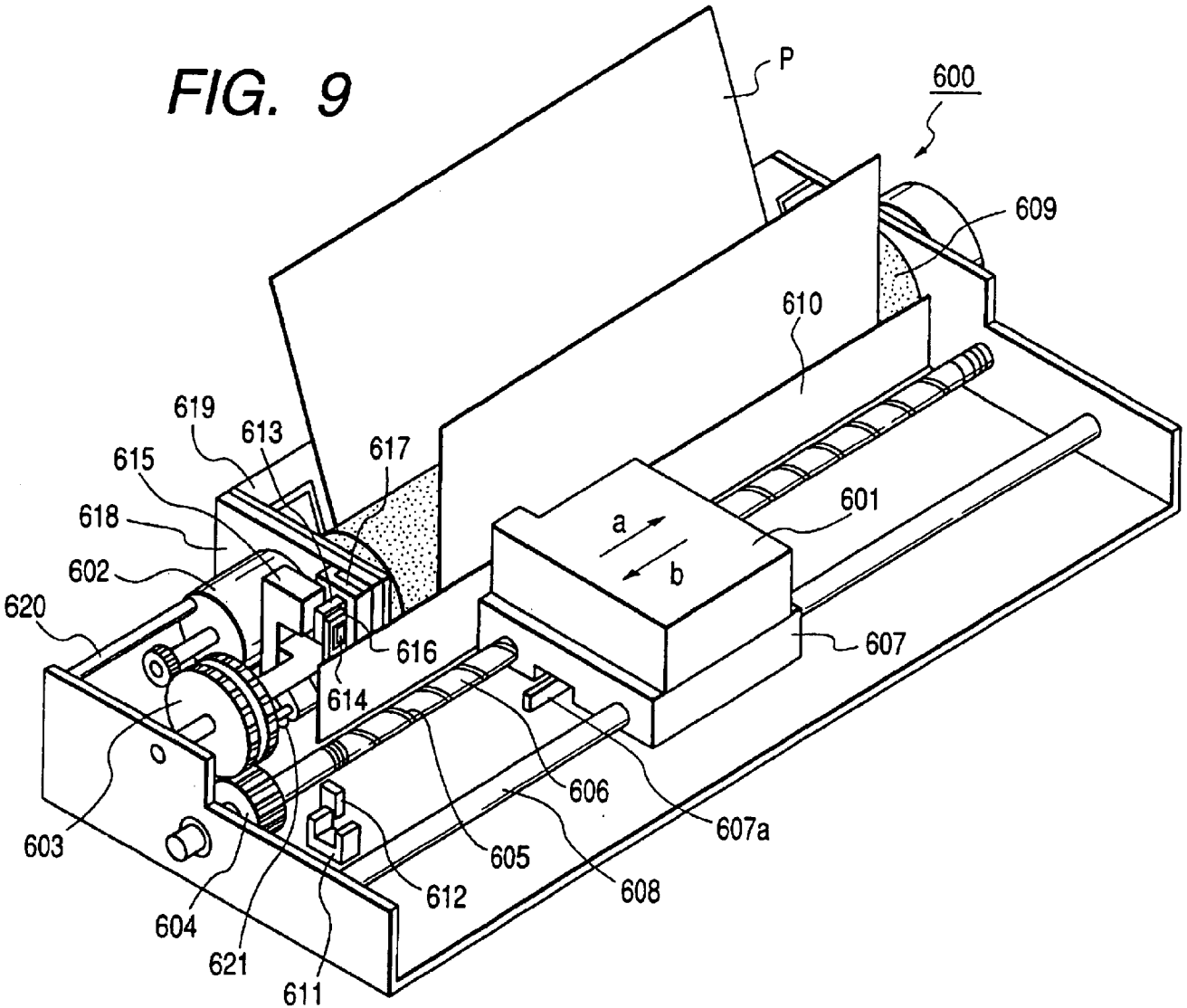
FIG. 9 is a liquid discharge apparatus according to one embodiment of the present invention.

FIG. 9 is a schematic perspective view showing one example of a liquid discharge device, to which a liquid discharge head is attached, according to the present invention. In FIG. 9, the reference numeral 601 is a liquid discharge head produced by the above-mentioned method. This head 601 is mounted on a carriage 607 engaged with the spiral groove 605 of a lead screw 606 which is rotated through driving force transmission gears 603 and 604 while interlocking the regular and reverse rotation of a driving motor 602, and is reciprocated in directions of arrows a and b together with the carriage 607 along a guide 608 by the power of the driving motor 602. A paper pressing plate 610 for a printing paper P which is carried on a platen 609 by a recording medium supply device not shown presses the printing paper P against the platen 609 over the direction of carriage movement.

Photocouplers 611 and 612 are provided in the vicinity of one end of the lead screw 606. These photocouplers 611 and 612 are home position detecting means which confirm the presence of the lever 607*a* of the carriage 607 in this area and switching of the rotational direction of the driving motor 602.

In FIG. 9 the reference numeral 613 denotes a supporting member for supporting a cap member 614 covering a front face of the discharge port of the above-mentioned liquid discharge head. Further the reference numeral 615 denotes an ink suction means which sucks ink collected in the internal portion of a cap member by discharging etc., from the head 601. The restoration of suction in the head 601 is carried out by this suction means 615 through an opening 616 in the cap. The reference numeral 617 denotes a cleaning blade, and the numeral 618 denotes a moving member which can move the blade in the front and rear directions (which is a direction vertical to the moving direction of the above-mentioned carriage 607). The blade 617 and the moving member 618 are supported on a body supporter 619. The blade 617 is not limited to the configuration shown in FIG. 9, but may be another well known cleaning blade. The reference numeral 620 denotes a lever which starts suction in the suction restoration. The lever 620 is moved as a cam 621 engaged with the carriage 607 is moved. The driving force from the driving motor 602 is controlled with a well known transmission means such as a clutch switch or the like. A liquid discharge controller which send a signal to the heat generating portion 102 provided in the head 601 and performs the above-mentioned driving control of each mechanism is provided on a device body side, and the controller is not shown in FIG. 9.

The liquid discharge apparatus 600 having the above-mentioned configuration records while the head 601 is reciprocated over the paper P which is a material to be recorded, which is carried on the platen with the recording material supply device not shown.

The present invention can be efficiently applied to a full-line type recording head having a length corresponding to the maximum width of the recording medium recordable with a recording device. As such a recording head, any configuration may be used, in which the length is satisfied by combination of a plurality of recording head or one recording head is integrally formed.

Further, with types or numbers of the recording heads mounted, in addition to only one recording head provided in accordance with for example single color ink, a plurality of recording heads provided in accordance with a plurality kinds of ink may be used. That is any recording head may be formed integrally or by the combination of the recording heads. The present invention is extremely efficient for a recording device provided with at least one recording mode for different colors or full colors by mixing colors.

The present invention will be concretely described using some examples. However, the present invention is not limited to only the examples.

EXAMPLE 1

As shown in FIGS. 1 and 2A and 2B, above an Si substrate 120 are formed a TaN layer 107 to a thickness of about 500 Å as a heating resistor by a reactive sputtering process, and Al layers 103, 104 to a thickness of about 5500 Å as electrode wiring by a sputtering process. Then Al is removed by wet-etching to expose a heat generating portion 102 shown by 102 in FIG. 1 using a photolithography process. The area of thus formed heat generating portion was 40×150 $\mu m^2$.

Then, a PSG film is formed to a thickness of about 7000 Å as a protective layer by a plasma CVD process, as shown in FIG. 2. Then, to form a pattern for opening on a thin protective layer-formed region 105 by a photolithography process as shown in FIG. 1, the PSG film is wet-etched using a buffered hydrofluoric acid, while using the TaN layer 107 of the heating resistor as an etching stop layer (stopper). The area of thus formed protective film-removed region was 42×50 $\mu m^2$.

An SiN film was formed on the resultant structure to a thickness of 4000 Å as a second protective layer by a plasma CVD process. Further, a Ta film is formed to a thickness of 2500 Å by a sputtering process and an opening for a desired pad is performed, whereby an ink jet recording head substrate (board) of the present example was prepared.

An ink jet recording head was produced by connecting a grooved top plate integrated with a discharge port plate provided with a discharge port having a diameter of 30 $\mu m$ to this substrate.

Figure 4A:
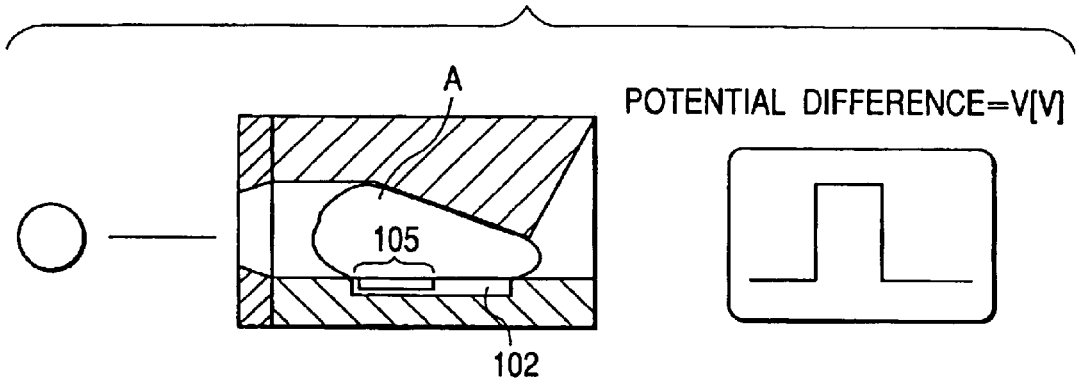
FIGS. 4A, 4B and 4C are schematic views for explaining the control of discharge amount in a liquid discharge head according to one embodiment of the present invention.
Figure 4B:
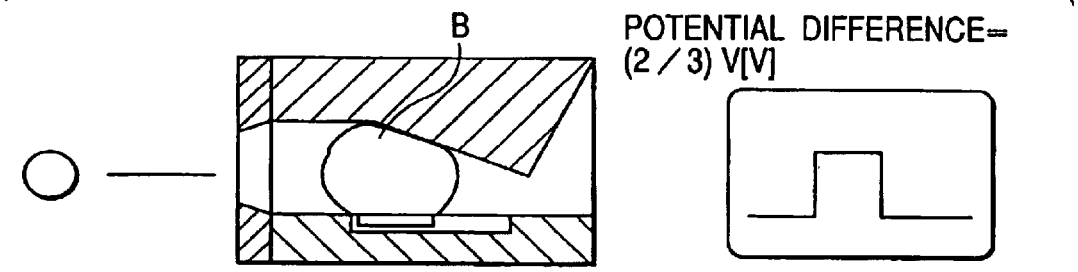

Droplets whose discharge amount is 80 ng were given by applying electric voltage pulse (width: 5 $\mu s$, height: 25 V) which heats to a temperature at which a bubble A is generated over the whole heat generating portion 102 by the film boiling, as shown in FIG. 4A. Further, a bubble B was generated by the film boiling in only the thin protective layer-formed region 105 as shown in FIG. 5B, by applying about ⅔ voltage necessary to generate a bubble A from the whole heat generating portion with a pulse width having the same level, thereby obtaining droplets having a discharge amount of 20 ng.

Figure 4C:
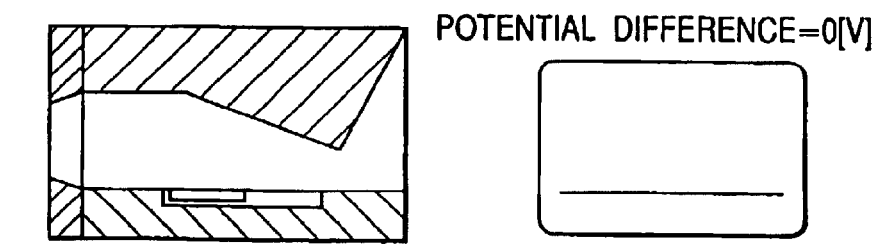

Incidentally, although three gradations (including non-discharge in FIG. 4C) are shown in the present example, a further multi-leveling can be performed by forming the thickness of the protective layer on the heat generating portion in a stepped-shape having three steps or more. Further, although the bubble power is controlled by an applied voltage to a heater resistor, this control is not limited to the applied voltage, but can be controlled by pulse length, pulse shape or the like.

EXAMPLE 2

After a heating resistor and a wiring material were formed by the same manner as in Example 1, an SiN film was formed on the substrate on which the heat generating element is exposed to a thickness of about 7000 Å as a first protective layer and a PSG film was formed thereon to a thickness of about 4000 Å. After that, to form a thin protective layer-formed region 105 in the heat generating portion, a photo resist was applied and patterned. The PSG film was then wet-etched using buffered hydrofluoric acid while using the above-described photo resist as a mask. After that, a Ta film which is used as an anti-cavitation layer and an ink resisting layer was formed to about a thickness of 2500 Å and an opening was formed, whereby an ink jet recording head substrate was prepared, in the same manner as in Example 1.

An ink jet recording head was produced using thus formed substrate, in the same manner as in Example 1. When an ink discharge was performed by controlling an applied voltage as in Example 1, a three-gradation discharge can be conducted as in Example 1.

EXAMPLE 3

After a heating resistor and a wiring material were formed by the same manner as in Example 1, an $SiO_2$ film was formed on the substrate on which the heat generating element is exposed to a thickness of about 7000 Å as a first protective layer and an SiN film was formed thereon to a thickness of about 4000 Å. After that, to form a thin protective layer-formed region 105 in the heat generating portion, a photo resist was applied and patterned. The SiN film was wet-etched using hot phosphoric acid while using the above-described photo resist as a mask. After that, a Ta film which is used as an anti-cavitation layer and an ink resisting layer was formed to about a thickness of 2500 Å and an opening was formed, whereby an ink jet recording head substrate was prepared, in the same manner as in Example 1.

An ink jet recording head was produced using thus formed substrate, in the same manner as in Example 1. When an ink discharge was performed by controlling an applied voltage as in Example 1, a three-gradation discharge can be conducted as in Example 1.

EXAMPLE 4

As shown in FIGS. 1 and 2A and 2B, above a Si substrate 120 are formed a TaN layer 107 to a thickness of about 500 Å as a heating resistor by a reactive sputtering process, and Al layers 103, 104 to a thickness of about 5500 Å as electrode wiring by a sputtering process. Then Al is removed by wet-etching to expose a heat generating portion 102 shown by 102 in FIG. 1 using a photolithography process. The area of thus formed heat generating portion was 40×100 $\mu m^2$.

Then, a PSG film is formed to a thickness of about 7000 Å as a protective layer by a plasma CVD process, as shown in FIGS. 2A and 2B. Then, to form a pattern for opening on a thin protective layer-formed region 105 by a photolithography process as shown in FIG. 1, the PSG film is wet-etched using a buffered hydrofluoric acid, while using the TaN layer 107 of the heating resistor as an etching stop layer (stopper). The area of thus formed protective film-removed region was 42×40 $\mu m^2$.

An SiN film was formed on this structure to a thickness of 4000 Å as a second protective layer by a plasma CVD process. Further, a Ta film is formed to a thickness of 2500 Å by a sputtering process and an opening for a desired pad is performed, whereby a liquid discharge head substrate (board) of the present example was prepared.

To form a flow path wall which defines a second liquid flow path 114 between the respective heat generating portions as shown in FIGS. 5 and 7, a dry film having a thickness of 15 $\mu m$ is applied with a spinner. After that each of flow paths was formed by using a photolithography process. A separating wall 115 was provided by use of a nickel plate having a thickness of 5 $\mu m$. A movable member 116 is formed in the separating wall 115 every flow path. The size of the separating wall 115 was 40×250 $\mu m^2$.

A liquid discharge head shown in FIGS. 3, 4A to 4C and 5 was produced by providing a grooved top plate integrated with a discharge port plate provided with a discharge port having a diameter of 30 $\mu m$ on this substrate. Then, as a bubbling liquid and a discharge liquid the liquids having the following compositions were used and the liquid discharge operations were confirmed.

| Bubbling liquid | |
|---|---|
| ethanol | 40 wt % |
| water | 60 wt % |
| **Discharge liquid (dye ink: viscosity 2 cp)** | |
| dye (C.I. Hood Black 2) | 3 wt % |
| diethylene glycol | 10 wt % |
| thiodiglycol | 5 wt % |
| ethanol | 2 wt % |
| water | the remainder |

Figure 8A:
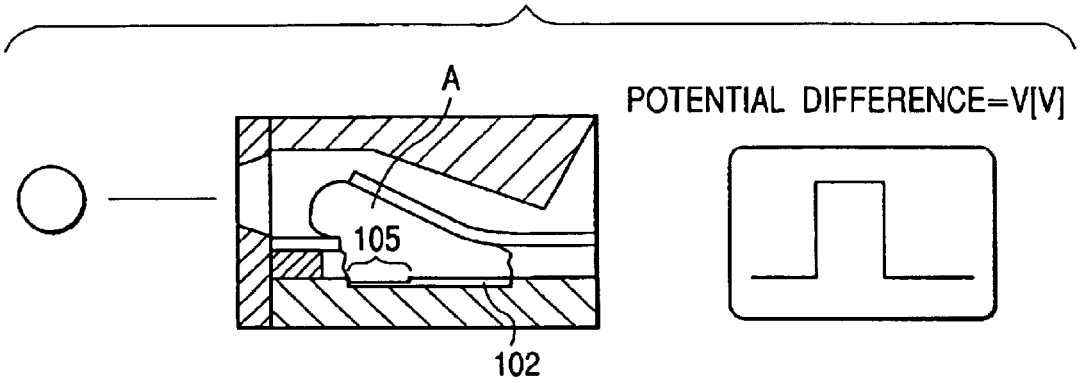
FIGS. 8A, 8B and 8C are schematic views for explaining the control of discharge amount in a liquid discharge head according to one embodiment of the present invention.
Figure 8B:
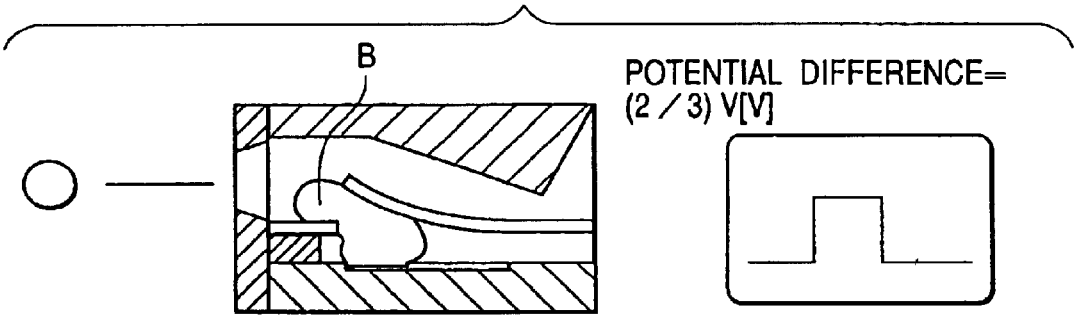

Droplets whose discharge amount is 80 ng were given by applying electric voltage pulse (width: 5 $\mu s$, height: 25 V) which heats to a temperature at which a bubble A is generated over the heat generating portion 102 by the film boiling, to a heat generating portion, as shown in FIG. 8A. Further, a bubble B was generated by the film boiling in only the thin protective layer-formed region 105 as shown in FIG. 8B, by applying about ⅔ voltage necessary to generate a bubble A from the whole heat generating portion with a pulse width having the same level, thereby obtaining droplets having a discharge amount of 20 ng.

Figure 8C:
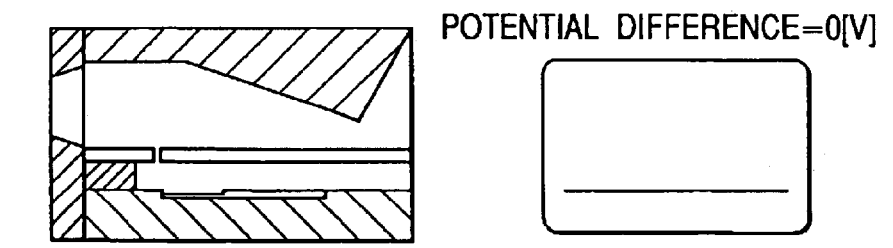

Incidentally, although three gradations including non-discharge in FIG. 8C are shown in the present example, a further multi-leveling can be performed by forming the thickness of the protective layer on the heat generating portion in a stepped-shape having three steps or more. Further, although the bubble power is controlled by an applied voltage to a heater resistor, this control is not limited to the applied voltage, but can be controlled by pulse length, pulse shape or the like.

EXAMPLE 5

After a heating resistor and a wiring material were formed by the same manner as in Example 1, an SiN film was formed on the substrate on which the heat generating element is exposed to a thickness of about 7000 Å as a first protective layer and a PSG film was formed thereon to a thickness of about 4000 Å. After that, to form a thin protective layer-formed region 105 in the heat generating portion, a photo resist was applied and patterned so that the PSG film was then wet-etched using buffered hydrofluoric acid while using the above-described photo resist as a mask. After that, a Ta film which is used as an anti-cavitation layer and an ink resisting layer was formed to about a thickness of 2500 Å and an opening was formed, whereby an ink jet recording head substrate was prepared, in the same manner as in Example 4.

An ink jet recording head was produced using thus formed substrate, in the same manner as in Example 4. When an ink discharge was performed by controlling an applied voltage as in Example 4, a three-gradation discharge can be conducted as in Example 4.

EXAMPLE 6

After a heating resistor and a wiring material were formed by the same manner as in Example 4, a $SiO_2$ film was formed on the substrate on which the heat generating element is exposed to a thickness of about 7000 Å as a first protective layer and a SiN film was formed thereon to a thickness of about 4000 Å. After that, to form a thin protective layer-formed region 105 in the heat generating portion, a photo resist was applied and patterned so that the SiN film was wet-etched using hot phosphoric acid while using the above-described photo resist as a mask. After that, a Ta film which is used as an anti-cavitation layer and an ink resisting layer was formed to about a thickness of 2500 Å and an opening was formed, whereby an ink jet recording head substrate was prepared, in the same manner as in Example 4.

An ink jet recording head was produced using thus formed substrate, in the same manner as in Example 1. When an ink discharge was performed by controlling an applied voltage as in Example 1, a three-gradation discharge could be conducted as in Example 1.

EXAMPLE 7

The same ink jet recording head as in Example 1 was produced except that the layer of a heating resistor was formed in the following manner.

In Example 7, as the layer of a heating resistor a polycrystalline silicon film is formed using a plasma CVD process. After that, impurity atoms such as B, P, As or the like were implanted into the polycrystalline silicon film using an ion-implantation process. Then, to uniformly diffuse the impurities into the heating resistor layer, annealing was carried out at 500 to 600° C. for 30 min. to 1 hr. Then, the heating resistor layer was patterned using a photolithography process.

In this example, a heating resistor having a positive temperature coefficient can be formed by doping the above-mentioned impurities onto a heating resistor layer composed of polycrystalline silicon. Thus, with the rise of the environmental temperature a resistance value of the heating resistor is increased. On the other hand, upon the temperature rise of the recording head, the viscosity of ink having the thixotropy properties is lowered and the ink is easy to move. Therefore, the influence caused by the temperature rise to energy applied to the heat generating portion tends to be cancelled. As a result, the amount of the liquid droplets discharged in accordance with the energy applied to the heat generating portion can be suitably controlled regardless of the influence of the temperature rise.

In this example, when an ink discharge was performed by controlling an applied voltage as in Example 1, a three-gradation discharge could be conducted as in Example 1.

EXAMPLE 8

The same ink jet recording head as in Example 4 was produced except that as the layer of a heating resistor the same material was used as in Example 7.

In this example, when an ink discharge was performed by controlling an applied voltage as in Example 1, a three-gradation discharge could be conducted as in Example 4.

What is claimed is:

1. A liquid discharge head comprising a heat generating element contacted with and between a pair of electrodes for generating thermal energy which is used for discharging liquid from a discharge port, and a protective film provided on said heat generating element to protect said heat generating element, wherein said protective film has a first region provided between said pair of electrodes, said first region having a substantially uniform thickness along a direction connecting said pair of electrodes, and has a second region provided between said pair of electrodes, said second region having a substantially uniform thickness along the direction, wherein said second region is thinner than said first region stepwise and is disposed asymmetrically only on a side of said discharge port between said pair of electrodes along the direction, wherein the volume of a liquid droplet discharged from said discharge port is changed by changing electric energy applied to said heat generating element, and wherein said protective film is composed of plural protection layers, said first region having more layers than said second region.

2. A liquid discharge head according to claim 1, wherein said second region is formed by forming an upper protective film after etching a lower protective film.

3. A liquid discharge head according to claim 2, wherein said lower protective film is composed of phosphosilicate glass film, said upper protective film is composed of SiN film, and said etching is conducted with buffered hydrofluoric acid.

4. A liquid discharge head according to claim 1, wherein said heat generating element is composed of material having a positive temperature coefficient.

5. A liquid discharge head according to claim 1, wherein said heat generating element is provided in plural numbers, a driving circuit having a plurality of function devices provided for independently driving said plurality of heat generating elements is provided within the substrate on which said heat generating elements is provided.

6. A liquid discharge head comprising a heat generating element contacted with and between a pair of electrodes for generating thermal energy which is used for discharging liquid from a discharge port, a protective film provided on said heat generating element to protect said heat generating element and a moving member provided facing said heat generating element and having a free end which is displaced in accordance with generation of a bubble due to said thermal energy, wherein said protective film has a first region provided between said pair of electrodes, said first region having a substantially uniform thickness along a direction connecting said pair of electrodes, and has a second region provided between said pair of electrodes, said second region having a substantially uniform thickness along the direction, wherein said second region is thinner than said first region stepwise and is disposed asymmetrically only on a side of said discharge port between said pair of electrodes along the direction, wherein the volume of a liquid droplet discharged from said discharge port is changed by changing electric energy applied to said heat generating element, and wherein said protective film is composed of plural protection layers, said first region having more layers than said second region.

7. A liquid discharge head according to claim 6, wherein said second region is formed by forming the upper protective film after etching the lower protective film.

8. A liquid discharge head according to claim 7, wherein said lower protective film is composed of phosphosilicate glass film, said upper protective film is composed of SiN film, and said etching is conducted with buffered hydrofluoric acid.

9. A liquid discharge head according to claim 6, wherein said heat generating element is composed of polycrystalline silicon.

10. A liquid discharge head according to claim 6, wherein said heat generating element is provided in plural numbers, a driving circuit having a plurality of function devices provided for independently driving said plurality of heat generating elements is provided within the substrate on which said heat generating elements is provided.

11. A liquid discharge apparatus comprising the liquid discharge head according to claim 1 or 6 and a member for mourning said liquid discharge head.

12. A liquid discharge method using a liquid discharge head having a heat generating element contacted with and between a pair of electrodes for generating thermal energy which is used for discharging liquid from a discharge port, and a protective film for protecting the heat generating element, provided on the heat generating element, said protective film having a first region provided between said pair of electrodes, said first region having a substantially uniform thickness along a direction connecting the pair of electrodes, and having a second region provided between said pair of electrodes, said second region having a substantially uniform thickness along the direction, wherein said second region is thinner than the first region stepwise and is disposed asymmetrically only on a side of said discharge port between said pair of electrodes along the direction, wherein a size of a bubble generated on the heat generating element is changed by changing electric energy applied to the heat generating element to generate a bubble on both the first region and the second region or on only the second region, wherein the volume of a liquid droplet discharged from the discharge port is changed, and wherein said protective film is composed of plural protection layers, said first region having more layers than said second region.

13. A liquid discharge method using a liquid discharge head having a heat generating element contacted with and between a pair of electrodes for generating thermal energy which is used for discharging liquid from a discharge port, a protective film for protecting the heat generating element, provided on the heat generating element and a moving member provided facing the heat generating element and having a free end which is displaced in accordance with generation of a bubble due to the thermal energy, the protective film having a first region provided between said pair of electrodes, said first region having a substantially uniform thickness along a direction connecting the pair of electrodes, and having a second region provided between said pair of electrodes, said second region having a substantially uniform thickness along the direction, wherein said second region is thinner than the first region stepwise and is disposed asymmetrically only on a side of said discharge port between said pair of electrodes along the direction, wherein a size of a bubble generated on the heat generating element is changed by changing electric energy applied to the heat generating element to generate a bubble on both the first region and the second region or on only the second region, wherein the volume of a liquid droplet discharged from the discharge port is changed, and wherein said protective film is composed of plural protection layers, said first region having more layers than said second region.

* * * * *

UNITED STATES PATENT AND TRADEMARK OFFICE

CERTIFICATE OF CORRECTION

PATENT NO. : 6,799,838 B2
APPLICATION NO. : 09/384971
DATED : October 5, 2004
INVENTOR(S) : Masahiko Kubota et al.

It is certified that error appears in the above-identified patent and that said Letters Patent is hereby corrected as shown below:

ON THE TITLE PAGE [54]:

Title, "LIQUID DISCHARGE HEAD LIQUID DISCHARGE METHOD AND LIQUID DISCHARGE APPARATUS" should read --LIQUID DISCHARGE HEAD, LIQUID DISCHARGE METHOD, AND LIQUID DISCHARGE APPARATUS--.

COLUMN 1:

Lines 1-3, "LIQUID DISCHARGE HEAD LIQUID DISCHARGE METHOD AND LIQUID DISCHARGE APPARATUS" should read --LIQUID DISCHARGE HEAD, LIQUID DISCHARGE METHOD, AND LIQUID DISCHARGE APPARATUS--.

COLUMN 2:

Line 2, "a" (first occurrence) should read --an--.

COLUMN 7:

Line 37, "this" should read --the--; and
Line 52, "When," should read --when,--.

COLUMN 8:

Line 54, "(Both" should read --(both--.

UNITED STATES PATENT AND TRADEMARK OFFICE

CERTIFICATE OF CORRECTION

PATENT NO. : 6,799,838 B2
APPLICATION NO. : 09/384971
DATED : October 5, 2004
INVENTOR(S) : Masahiko Kubota et al.

It is certified that error appears in the above-identified patent and that said Letters Patent is hereby corrected as shown below:

COLUMN 15:

Line 26, “a driving” should read --and a driving--;
Line 29, “is” should read --are--; and
Line 32, “mourning” should read --mounting--.

Signed and Sealed this

Twenty-first Day of November, 2006

JON W. DUDAS
*Director of the United States Patent and Trademark Office*

UNITED STATES PATENT AND TRADEMARK OFFICE

CERTIFICATE OF CORRECTION

PATENT NO. : 6,799,838 B2
APPLICATION NO. : 09/384971
DATED : October 5, 2004
INVENTOR(S) : Masahiko Kubota et al.

It is certified that error appears in the above-identified patent and that said Letters Patent is hereby corrected as shown below:

ON THE TITLE PAGE [54]:

Title, "LIQUID DISCHARGE HEAD LIQUID DISCHARGE METHOD AND LIQUID DISCHARGE APPARATUS" should read --LIQUID DISCHARGE HEAD, LIQUID DISCHARGE METHOD, AND LIQUID DISCHARGE APPARATUS--.

COLUMN 1:

Lines 1-3, "LIQUID DISCHARGE HEAD LIQUID DISCHARGE METHOD AND LIQUID DISCHARGE APPARATUS" should read --LIQUID DISCHARGE HEAD, LIQUID DISCHARGE METHOD, AND LIQUID DISCHARGE APPARATUS--.

COLUMN 2:

Line 2, "a" (first occurrence) should read --an--.

COLUMN 7:

Line 37, "this" should read --the--; and
Line 52, "When," should read --when,--.

COLUMN 8:

Line 54, "(Both" should read --(both--.

UNITED STATES PATENT AND TRADEMARK OFFICE

CERTIFICATE OF CORRECTION

PATENT NO. : 6,799,838 B2
APPLICATION NO. : 09/384971
DATED : October 5, 2004
INVENTOR(S) : Masahiko Kubota et al.

It is certified that error appears in the above-identified patent and that said Letters Patent is hereby corrected as shown below:

COLUMN 15:

Line 26, “a driving” should read --and a driving--;
Line 29, “is” should read --are--; and
Line 32, “mourning” should read --mounting--.

Signed and Sealed this

Twenty-sixth Day of December, 2006

JON W. DUDAS
*Director of the United States Patent and Trademark Office*